US007604536B2

(12) United States Patent
Coulton et al.

(10) Patent No.: US 7,604,536 B2
(45) Date of Patent: Oct. 20, 2009

(54) ROOF RIDGE VENT HAVING HONEYCOMB OR LIKE VENTILATION MATERIAL

(75) Inventors: Michael S Coulton, North Wales, PA (US); George Caruso, Ambler, PA (US)

(73) Assignee: Benjamin Obdyke Incorporated, Horsham, PA (US)

( * ) Notice: Subject to any disclaimer, the term of this patent is extended or adjusted under 35 U.S.C. 154(b) by 673 days.

(21) Appl. No.: 11/244,775

(22) Filed: Oct. 6, 2005

(65) Prior Publication Data

US 2006/0079173 A1 Apr. 13, 2006

Related U.S. Application Data

(60) Provisional application No. 60/617,151, filed on Oct. 8, 2004.

(51) Int. Cl.
*F24F 7/02* (2006.01)

(52) U.S. Cl. ..... 454/365

(58) Field of Classification Search ..... 454/365
See application file for complete search history.

(56) References Cited

U.S. PATENT DOCUMENTS

| | | | | |
|---|---|---|---|---|
| 3,949,657 | A | 4/1976 | Sells | |
| 4,942,699 | A | 7/1990 | Spinelli | 52/57 |
| 5,603,657 | A * | 2/1997 | Sells | 454/359 |
| 5,673,521 | A | 10/1997 | Coulton et al. | 52/199 |
| 5,704,509 | A * | 1/1998 | Rosenkrantz | 220/216 |
| 5,704,834 | A | 1/1998 | Sells | 454/365 |
| 5,902,432 | A | 5/1999 | Coulton et al. | 156/199 |
| 5,921,863 | A | 7/1999 | Sells | 454/359 |
| 5,960,595 | A | 10/1999 | McCorsley, III et al. | 52/199 |
| 6,213,868 | B1 | 4/2001 | Sells | 454/359 |
| 6,298,613 | B1 | 10/2001 | Coulton et al. | 52/199 |
| 6,308,472 | B1 | 10/2001 | Coulton et al. | 52/198 |
| 6,450,882 | B1 | 9/2002 | Morris et al. | 454/365 |
| 6,623,354 | B2 * | 9/2003 | Morris et al. | 454/365 |
| 2004/0029523 | A1 | 2/2004 | Morris et al. | 454/365 |

OTHER PUBLICATIONS

MWI Components, Uni-Vent The Universal Ventilation System, 2 pages, Jan. 2005.

* cited by examiner

*Primary Examiner*—Steven B McAllister
*Assistant Examiner*—Samantha A Miller
(74) *Attorney, Agent, or Firm*—Howson & Howson LLP

(57) ABSTRACT

A roof ridge vent and installation includes a ventilation material having walls defining a plurality of separate open cellular cavities, such as a honeycomb material, that may or may not extend from the underside of a separate sheet material. Preferably, the walls of the ventilation material extend substantially vertically within the vent, and paths of ventilation, which extend from on open slot on the roof ridge to either longitudinally-extending side edge of the vent, extend transversely through the walls of the ventilation material. To this end, the walls are perforated or are made of an air permeable material, more preferably, a non-wicking hydrophobic material or a non-woven fabric having a multiplicity of closely spaced openings. Alternatively, paths of ventilation can be provided by channels formed between adjacent, spaced-apart sections of the ventilation material. Preferably, the vent is continuous and elongate and is stored and shipped in a spiral roll.

32 Claims, 13 Drawing Sheets

ROOF RIDGE VENT HAVING HONEYCOMB OR LIKE VENTILATION MATERIAL

CROSS-REFERENCE TO RELATED APPLICATIONS

This application claims the benefit under 35 USC §119(e) of U.S. Provisional Patent Application No. 60/617,151, filed Oct. 8, 2004.

BACKGROUND OF THE INVENTION

The present invention relates to a roof ridge vent that enables the circulation of air between a roof of a building and an underlying ceiling structure.

It is useful, and in many locales a building code requirement, that the attic area of a building be provided with a means to permit air exchange. Such ventilation prevents undue heat buildup, which can render the living quarters of the building uncomfortable and impose unreasonable energy requirements for cooling. Proper ventilation of the attic area also tends to preserve the structural integrity of the roof and roof coverings. One method of venting the roof structure consists of applying a venting media over a slot present along the ridge of a roof. These types of vents are known as ridge vents.

Examples of ridge vents are provided by U.S. Pat. No. 5,960,595 issued to McCorsley et al.; U.S. Pat. No. 6,298,613 issued to Coulton et al.; U.S. Pat. No. 6,308,472 issued to Coulton et al.; U.S. Pat. No. 5,902,432 issued to Coulton et al.; U.S. Pat. No. 5,673,521 issued to Coulton et al.; and U.S. Pat. No. 4,942,699 issued to Spinelli. These patents are owned, or co-owned, by Benjamin Obdyke, Inc., the assignee of the present application.

While the roof ridge vents disclosed in the above referenced patents function in a superior manner, there continues to be a need for alternatives with respect to the design, materials and manufacturing of roof ridge vent products. To this end, the vent should permit a sufficient amount of ventilating air flow without compromising weather infiltration resistance and should be capable of being properly installed in a manner requiring labor skills possessed by the average roof installer. In addition, the vent should be capable of efficient manufacture from inexpensive materials and should be capable of being formed into a roll for shipping, transportation and subsequent installation on a roof ridge.

BRIEF SUMMARY OF THE INVENTION

More specifically, the present invention provides a roof ridge vent made of an elongate, continuous strip of a material having walls defining a plurality of separate open cellular cavities, such as a honeycomb material. The strip of material has an upper face for supporting cap shingles, a lower face for engaging a roof, and a pair of longitudinally-extending side edges through which paths of ventilation are provided. The walls and cavities of the material extend in a direction from the lower face to the upper face, and the paths of ventilation extend transversely through the walls of the material.

Preferably, the vent is rollable lengthwise into a spiral roll for storage and transport, and the walls of the material have a composite strength in compression sufficient to support overlying cap shingles. The walls of the material can be perforated or made of an air permeable material, such as a non-wicking hydrophobic material that has a multiplicity of closely spaced openings permitting a flow of venting air therethrough. According to one contemplated embodiment, the material has a flexible longitudinally-extending center section that permits the material to conform to an inverted-V shape of a roof ridge.

According to another aspect of the present invention, a roof ridge vent is made of a continuous, elongate strip of sheet material having an underside to which a material having walls defining a plurality of separate open cellular cavities, such as a honeycomb material, is bonded. The walls and cavities of the material extend downwardly from the sheet material, more preferably, substantially perpendicular to the underside of the sheet material. The material with the walls and cavities defines paths of ventilation that extend transversely through its walls as discussed above. According to one contemplated embodiment, the material comprises a pair of continuous, elongate strips of honeycomb material that are secured to the underside of the sheet material on opposite sides of a longitudinally-extending centerline of the sheet material. Alternatively, the material with walls and cavities can comprise a plurality of separate sections that are spaced-apart along the length of the sheet material and that define paths of ventilation therebetween. In such an embodiment, an outermost wall of each section can form a part of a longitudinally-extending side edge of the vent that is free to pivot when wind blows into the vent to close an adjacent one of the paths of ventilation to prevent weather infiltration.

According to yet another aspect of the present invention, a roof ridge vent installation includes a roof having a ridge with an elongate open slot, an elongate, continuous ridge vent secured to the roof overlying the ridge and open slot, and cap shingles overlying the ridge vent. The vent is constructed of a material having walls defining a plurality of separate open cellular cavities, such as a honeycomb material, as discussed above. The walls of the material are oriented in an upstanding position relative to the underlying roof and provide a path of ventilation transversely therethrough from the open slot to the longitudinally-extending side edge of the vent.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE INVENTION

Figure 3:
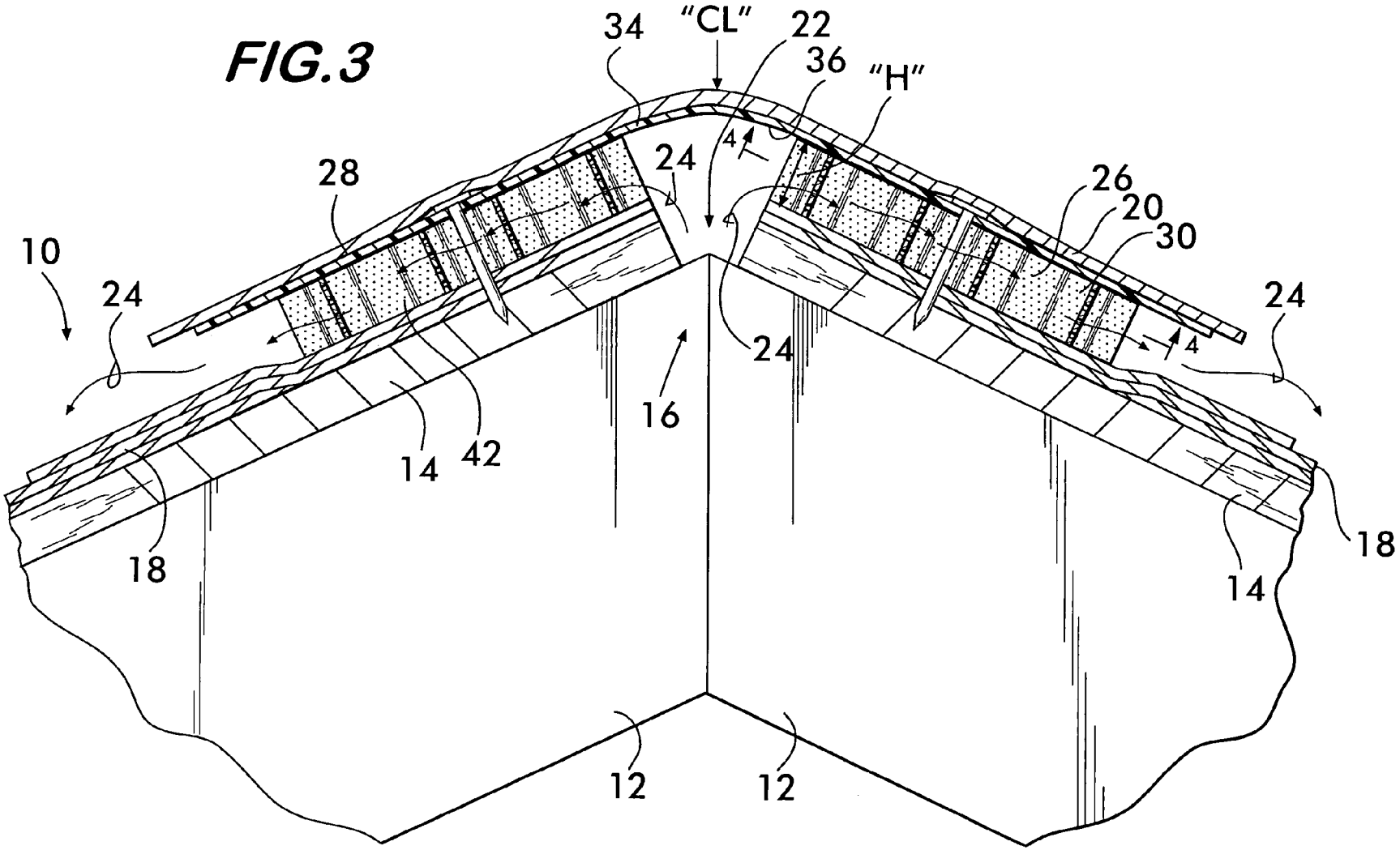
FIG. 3 is an elevational cross-sectional view of the roof ridge vent of FIG. 1 installed on a roof ridge according to the present invention.
Figure 4:
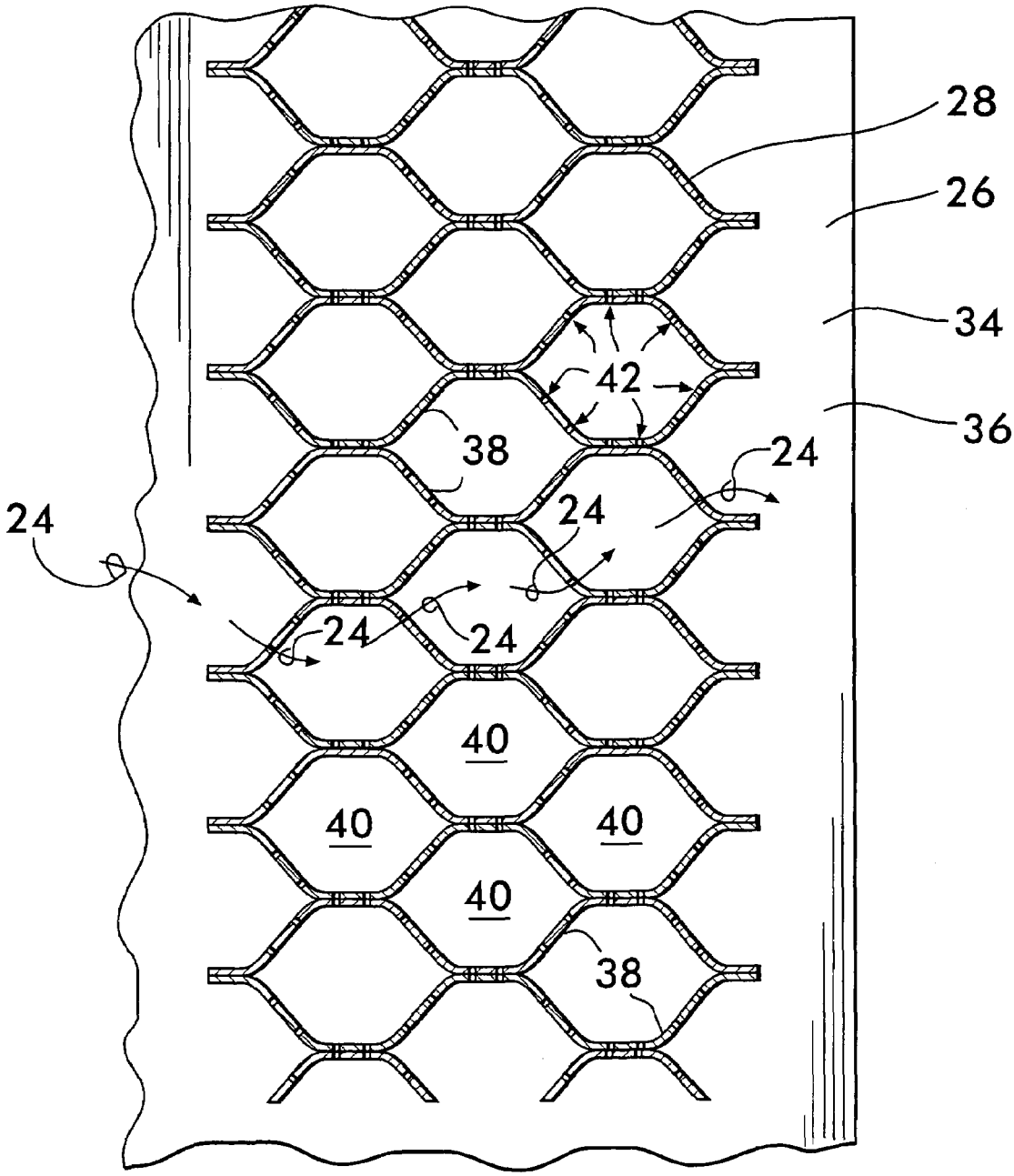
FIG. 4 is a cross-sectional view taken along the line 4-4 of FIG. 3 showing a path of ventilation through the vent.
Figure 5:
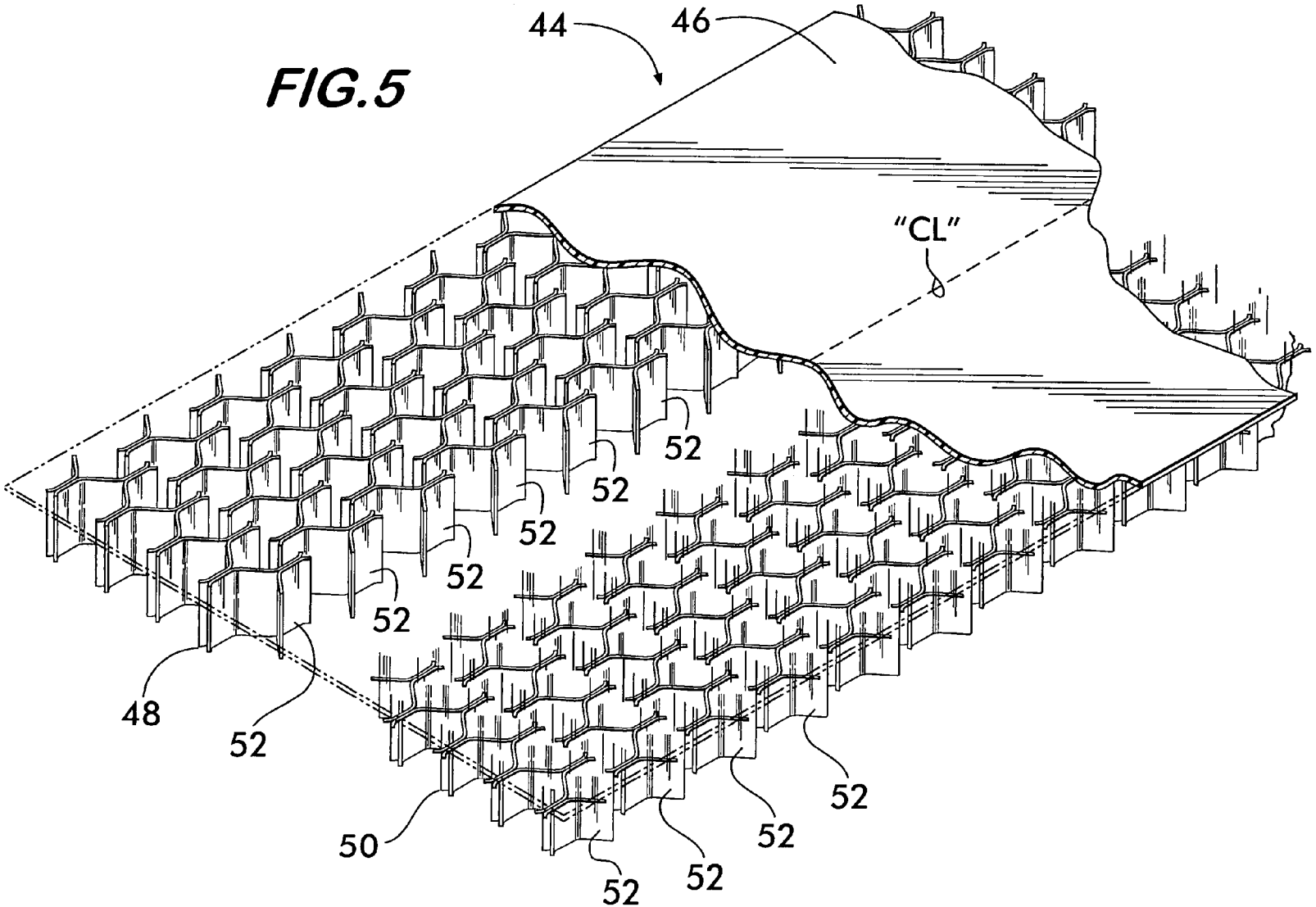
FIG. 5 is a partially-cutaway perspective view of a section of an elongate, unrolled roof ridge vent according to a second embodiment of the present invention.
Figure 6:
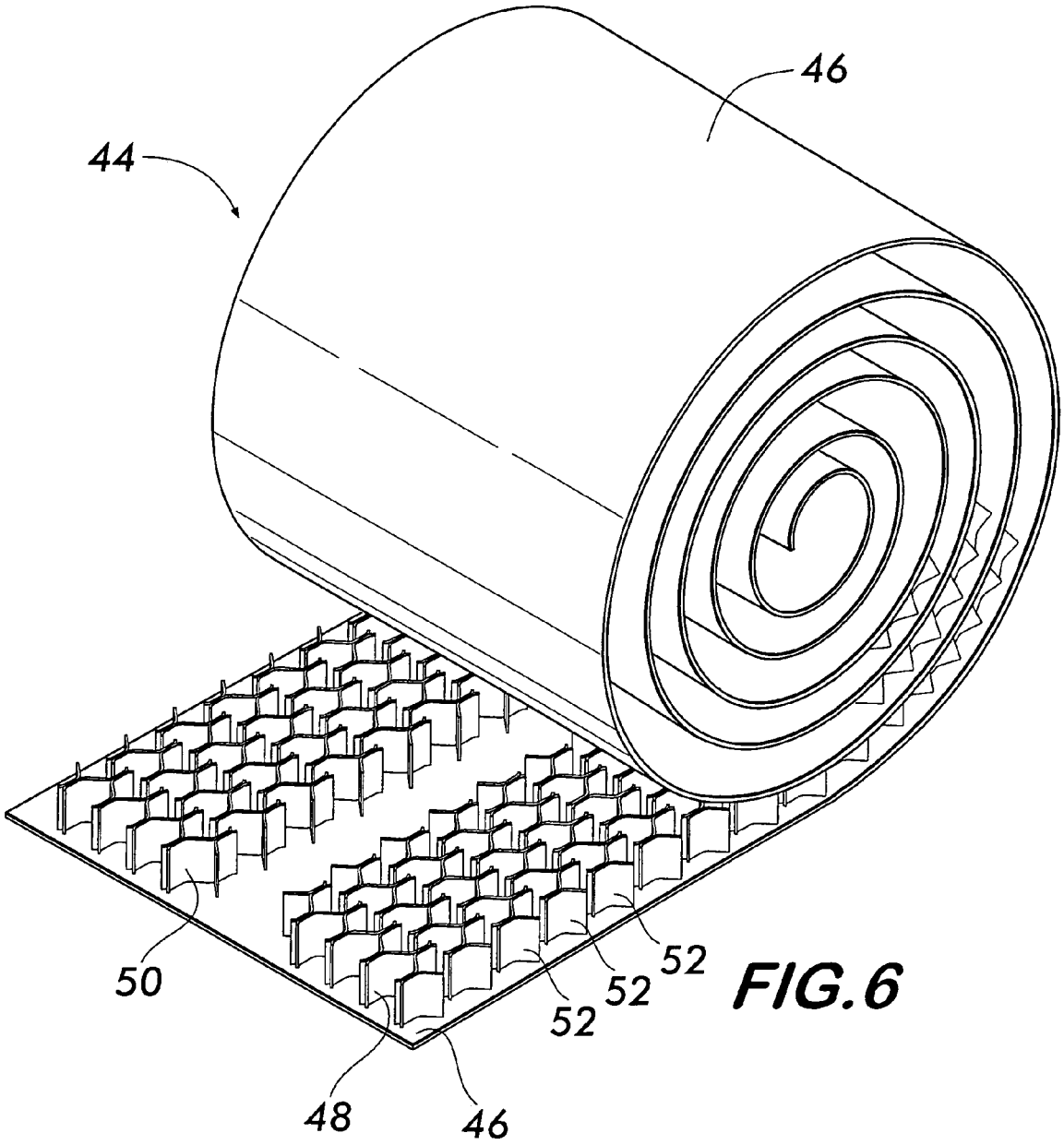
FIG. 6 is a perspective view of the vent of FIG. 5 in a spiral roll.
Figure 7:
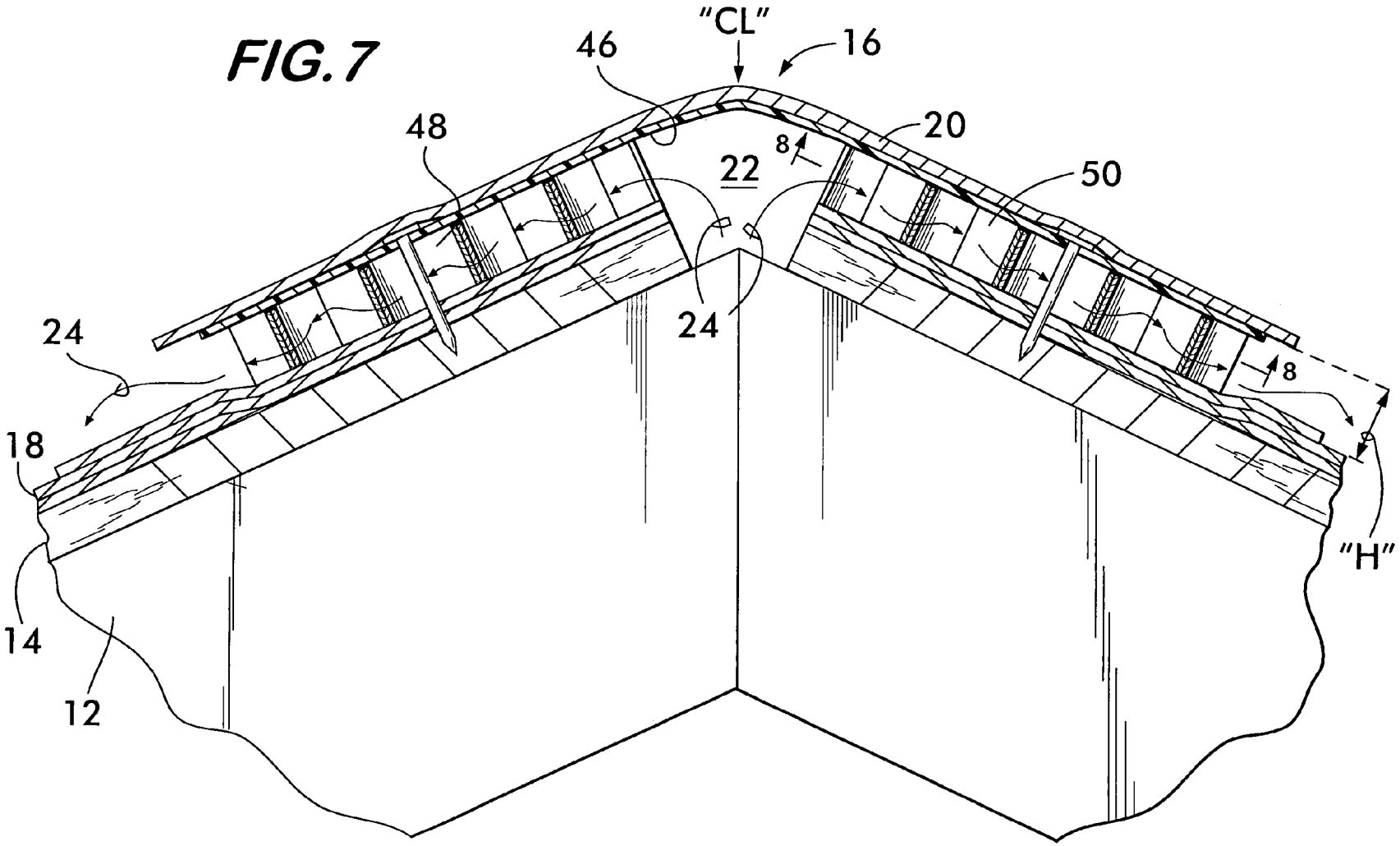
FIG. 7 is an elevational cross-sectional view of the roof ridge vent of FIG. 5 installed on a roof ridge according to the present invention.
Figure 8:
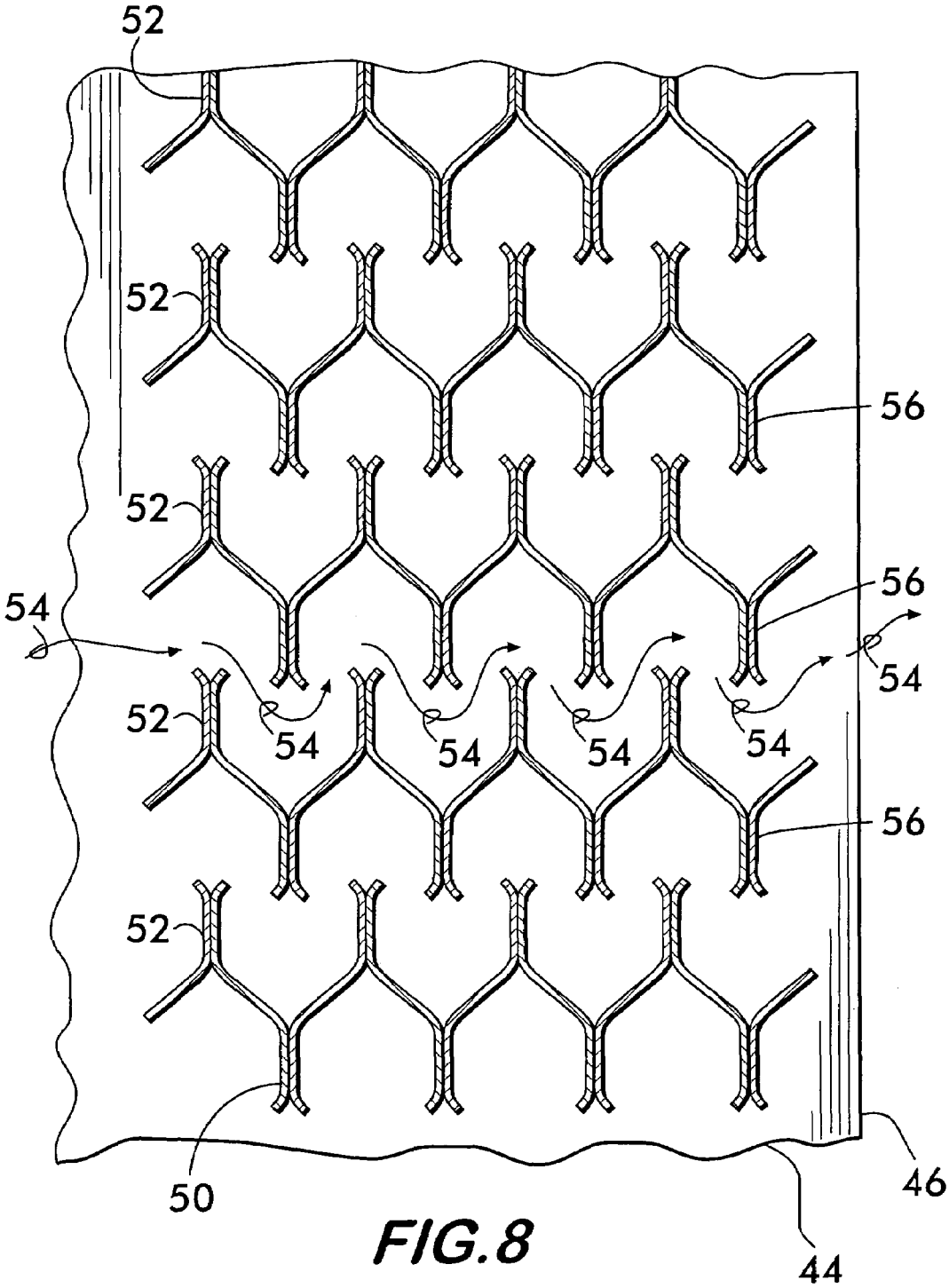
FIG. 8 is a cross-sectional view taken along the line 8-8 of FIG. 7 showing a path of ventilation through the vent.
Figure 12:
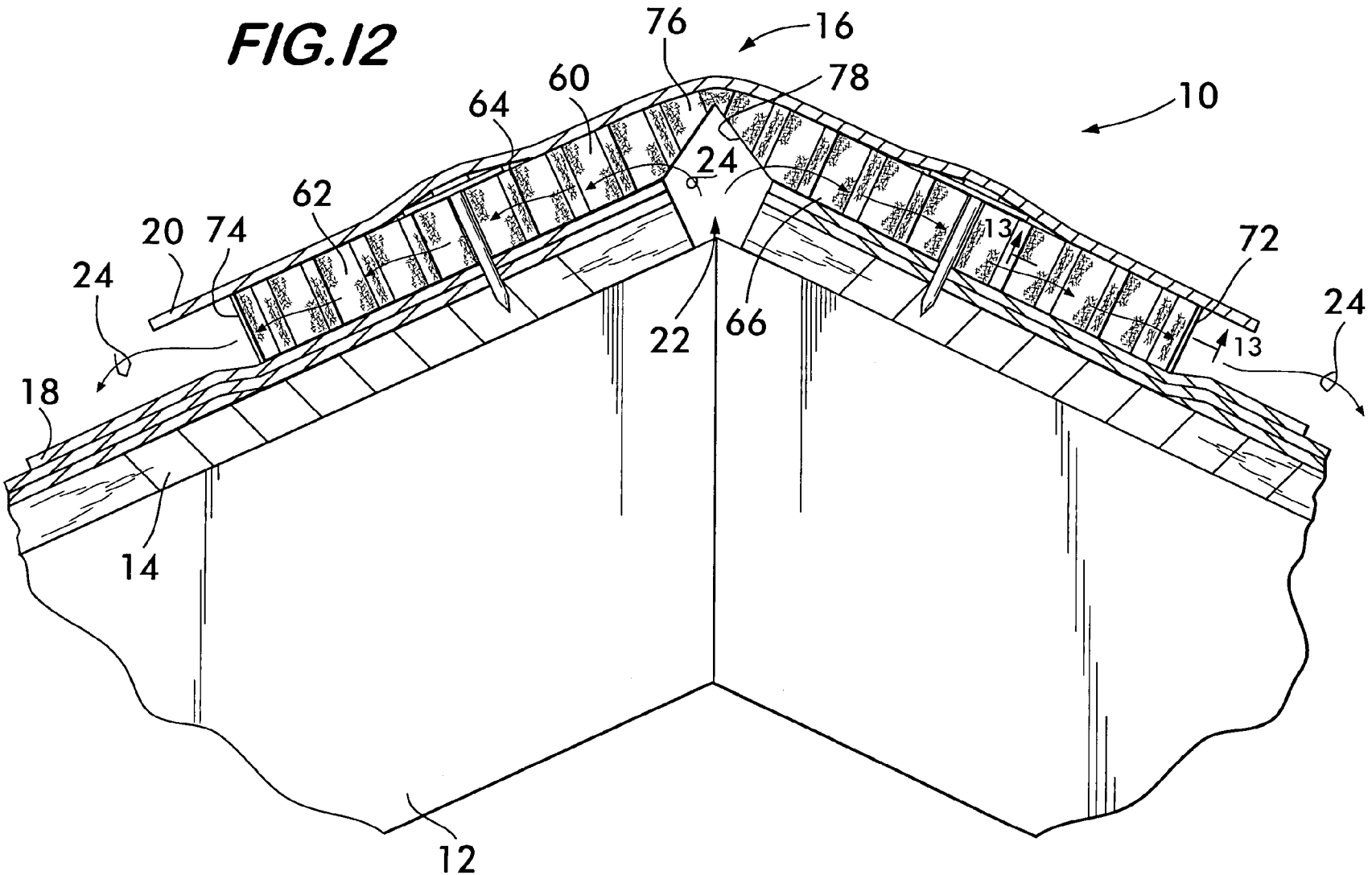
FIG. 12 is an elevational cross-sectional view of the roof ridge vent of FIG. 10 installed on a roof ridge according to the present invention.
Figure 13:
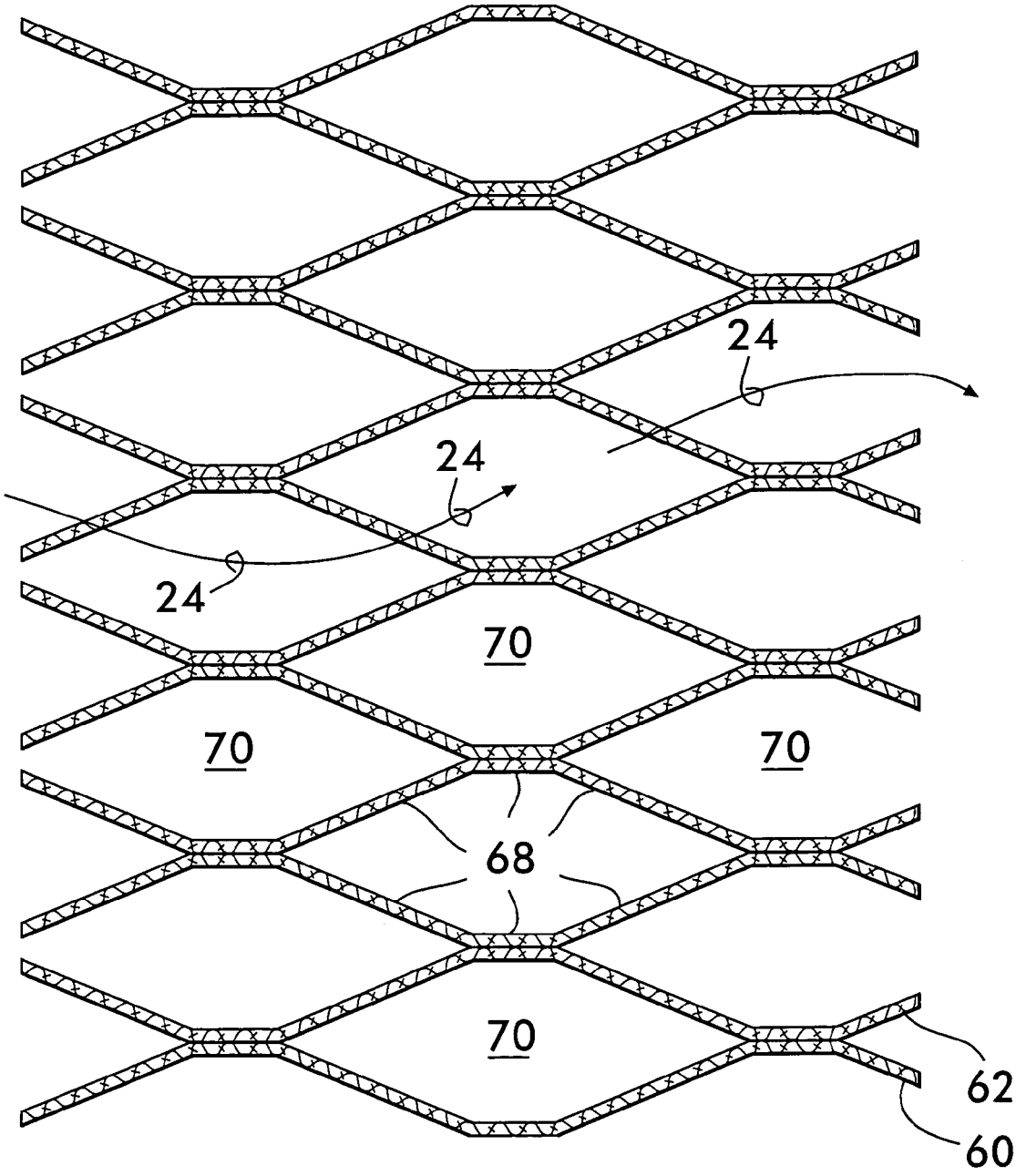
FIG. 13 is a cross-sectional view taken along the line 13-13 of FIG. 12 showing a path of ventilation through the vent.

Referring now to the drawings, FIGS. 3, 7 and 12 each illustrate a roof 10 having a typical construction which utilizes a ridge vent. The roof 10 is constructed from a plurality of rafters 12 supported at their lower ends, for instance, by front and rear walls (not shown) of the building. A roof deck 14 is typically constructed of plywood, or other suitable panels, to provide an outer sheathing of the building. The roof deck 14 is secured to the rafters 12, extends to the end walls, and forms a ridge, or peak, 16 therebetween. Shingles 18 or like exterior building materials are secured to the roof deck 14 to finish sloping portions of the roof 10 in accordance with conventional construction practices. Caps or cap shingles 20 are installed overlying the ridge vent to cover the ridge 16 of the roof 10. An open slot 22 is provided along the length of the roof ridge 16 to provide a passageway for air to vent from the underlying attic area to the ambient atmosphere as illustrated by arrows 24 in each of FIGS. 3, 7 and 12.

A roof ridge vent according to the present invention is constructed of a ventilation material having walls defining a plurality of separate cellular cavities. The material can be, for instance, a honeycomb ventilation material or the like. The ventilation material may or may not be used in connection with a sheet backer material, as will be discussed. The ventilation material has a network of interconnected walls that form a mass of separate cells, or cavities, located in side-by-side relation. Although the typical dictionary definition of the term "honeycomb" requires cells of a hexagon shape, for purposes of the present invention the terms "honeycomb material" and "ventilation material having walls defining a plurality of separate cellular cavities" are also used to define materials having cells or cavities of any shape, including for instance, square, rectangular, triangular, diamond, circular and oval shapes.

According to the present invention, the walls and cavities of the honeycomb material extend in a direction defining the thickness, or height, "H" of the vent. To this end, the honeycomb material has an underside for engaging a surface of the roof, an upper face adjacent the cap shingles, and sides that form the longitudinally-extending side edges of the vent. Thus, the paths of ventilation 24 extending from the open slot 22 in the roof 10 to the side edges of the vent extend transversely of the walls of the honeycomb material through the walls of the honeycomb material.

The walls of the honeycomb material have a composite strength in compression sufficient to support overlying cap shingles. The walls can be made of an air impermeable material, such as plastic, cardboard, metal, or the like, or of an air permeable material. If an air impermeable material is utilized, perforations can be made through the walls to provide ventilation passageways. Alternatively, the honeycomb material can be provided as discontinuous, spaced-apart strips that provide a path of ventilation therebetween. Permeable walls can include those made of a plastic or metal mesh material or fabric material such as a non-wicking hydrophobic material or a non-woven fabric. Preferably, the permeable wall materials provide a multiplicity of closely spaced openings permitting a flow of air therethrough, but preventing the infiltration of weather, insects and the like.

Figure 1:
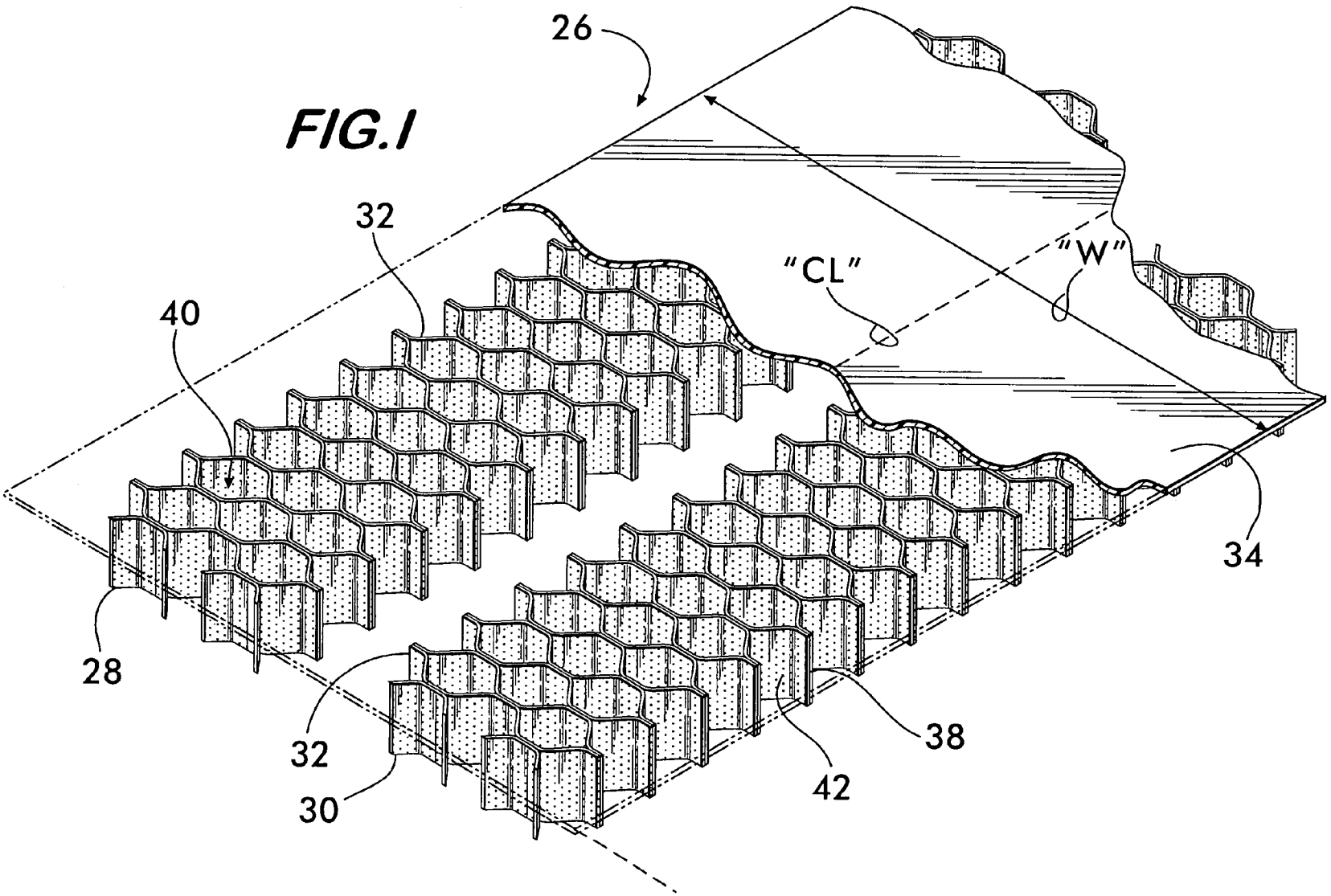
FIG. 1 is a partially-cutaway perspective view of a section of an elongate, unrolled roof ridge vent according to a first embodiment of the present invention.
Figure 2:
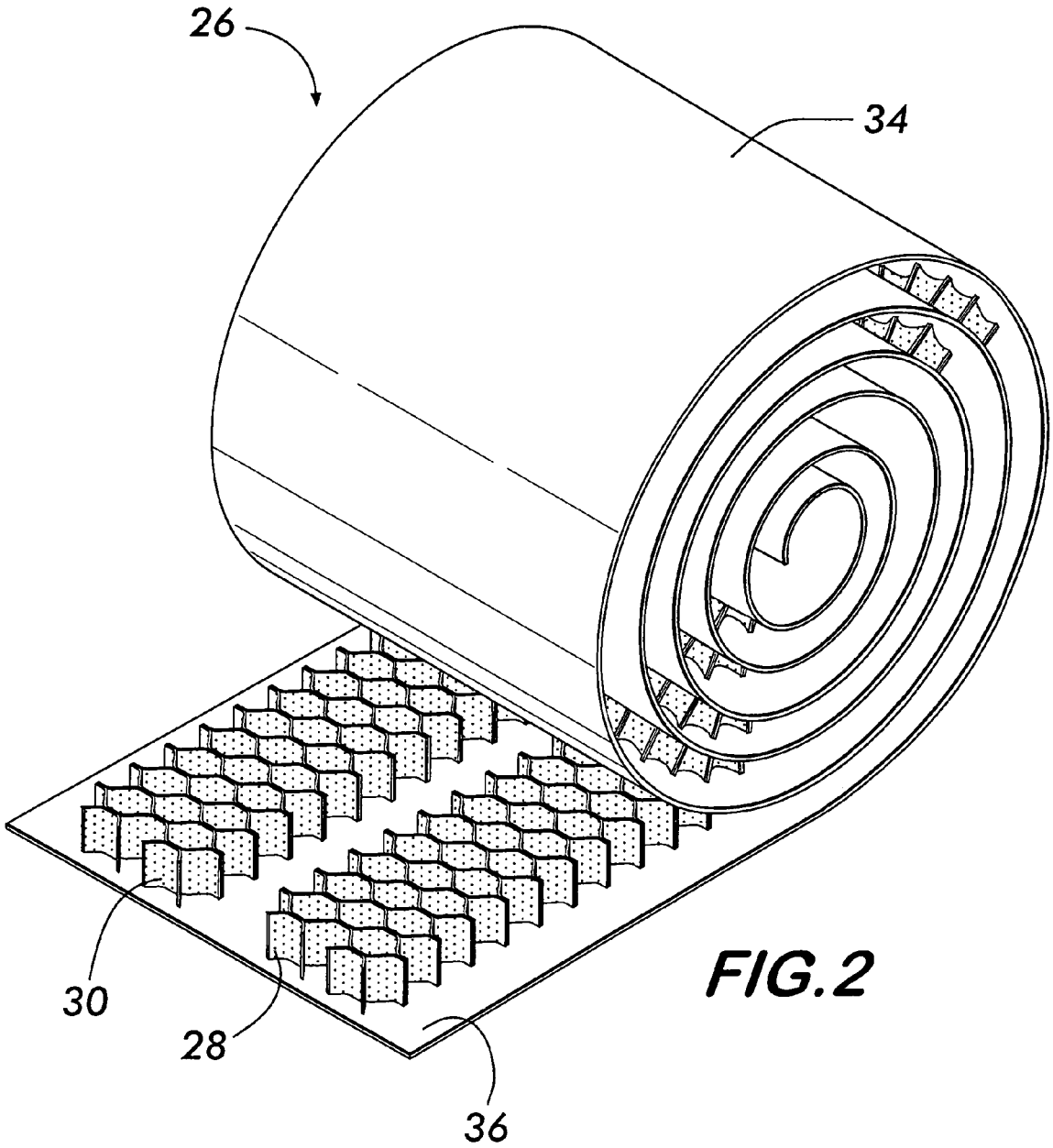
FIG. 2 is a perspective view of the vent of FIG. 1 in a spiral roll.

Turning to a first embodiment of the present invention illustrated in FIGS. 1-4, a vent 26 has a pair of continuous, elongate strips of honeycomb material, 28 and 30, each with an upper face 32 bonded to the underside 36 of a continuous, elongate backer sheet material 34. As best illustrated in FIG. 2, the honeycomb material and backer sheet combination can be rolled into a spiral during or after manufacture, stored and transported in roll-form, and unrolled during installation on a roof ridge. The strips of the honeycomb material, 28 and 30, can be, for instance, adhesively or thermally bonded to the backer material 34 on opposite sides of a longitudinally-extending centerline "CL" of the backer material 34 so that, when installed, the strips, 28 and 30, extend on opposite sides of the open slot 22 in the roof ridge 16. See FIG. 3. The backer sheet 34 can be made of a plastic, thermoplastic, fabric, non-woven fabric, cardboard, metal or like material.

When installed on a roof ridge 16 as illustrated in FIG. 3, the backer sheet 34 is flexed about or near its centerline "CL" into an inverted-V shape to conform to the shape of the roof ridge 16. This positions the pair of ventilation strips, 28 and 30, on opposite sides of the open slot 22 of the roof ridge 16. The pair of ventilation strips, 28 and 30, support and space the backer sheet 34 and cap shingles 20 above the surface of the roof ridge 16. Thus, paths of ventilation 24 extend from the open slot 22 transversely through the walls 38 and cavities 40 of the honeycomb ventilation material between the backer sheet 34 and the underlying roof surface. See FIGS. 3 and 4. The walls 38 have a plurality of openings 42 permitting air to flow therethrough. However, preferably the openings 42 are sufficiently small to prevent the entry of in-blowing rain and/or snow, and preferably the walls 38 are made of a material that resists wicking moisture to the slot 22.

A second embodiment according to the present invention is illustrated in FIGS. 5-9. Similar to the first embodiment, vent 44 includes a backer sheet 46 to which a pair of honeycomb ventilation material strips, 48 and 50, are bonded. However, in this embodiment the walls 52 of the honeycomb material are preferably impermeable to air and moisture and are provided as discontinuous cut sections 52. Thus, each strip, 48 and 50, includes a plurality of cut honeycomb sections 52 that are spaced-apart and offset from adjacent sections 52 thereby forming an undulating open ventilation path 54 between each adjacent pair of sections 52. See FIG. 8. A benefit of using an undulating ventilation path instead of a straight ventilation path is that weather infiltration to the slot 22 due to blowing rain and/or snow is reduced.

Figure 9:
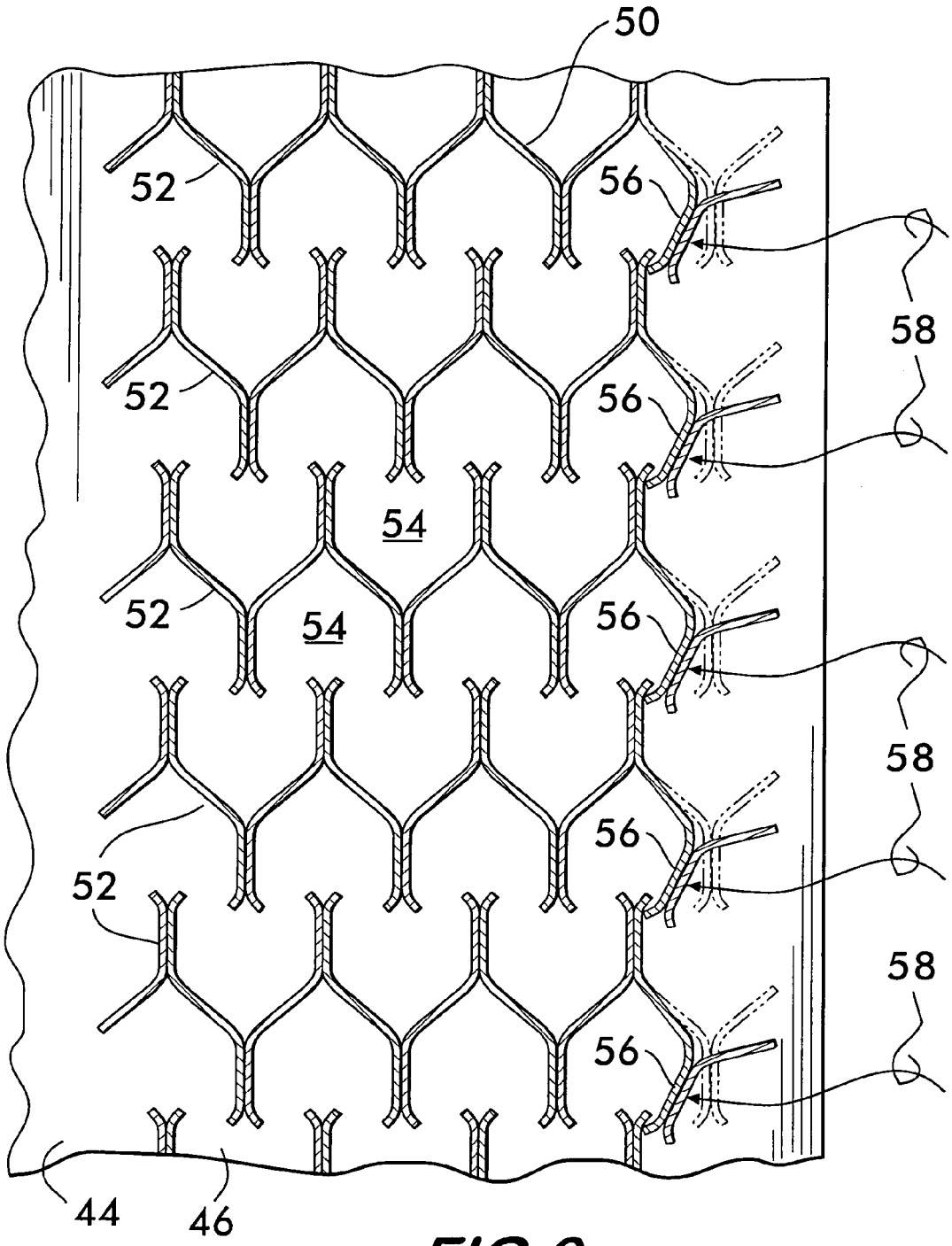
FIG. 9 is a cross-sectional view taken along the line 8-8 of FIG. 7 showing the effect of wind blowing into the vent.
Figure 10:
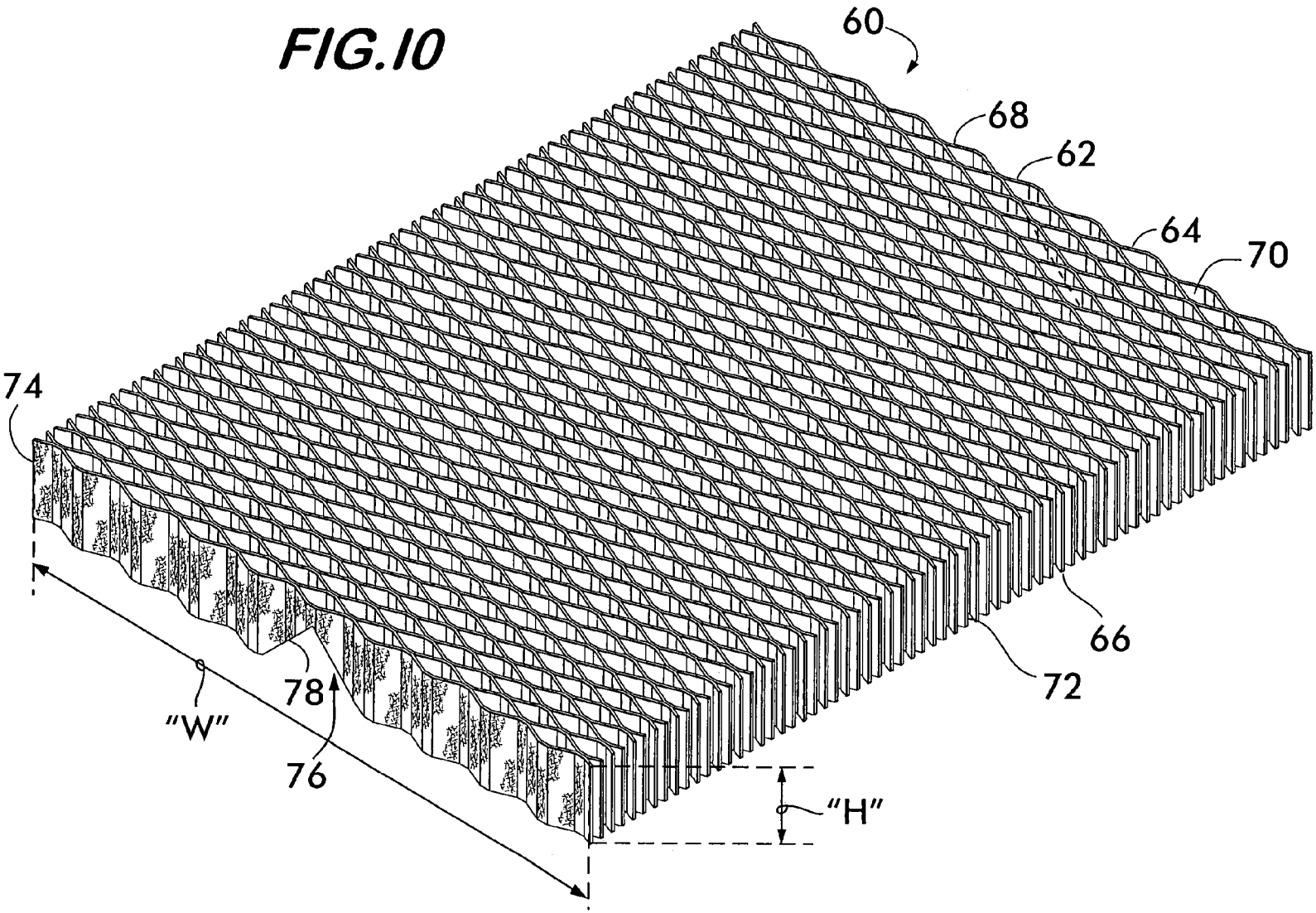
FIG. 10 is a perspective view of a section of an elongate, unrolled roof ridge vent according to a third embodiment of the present invention.
Figure 11:
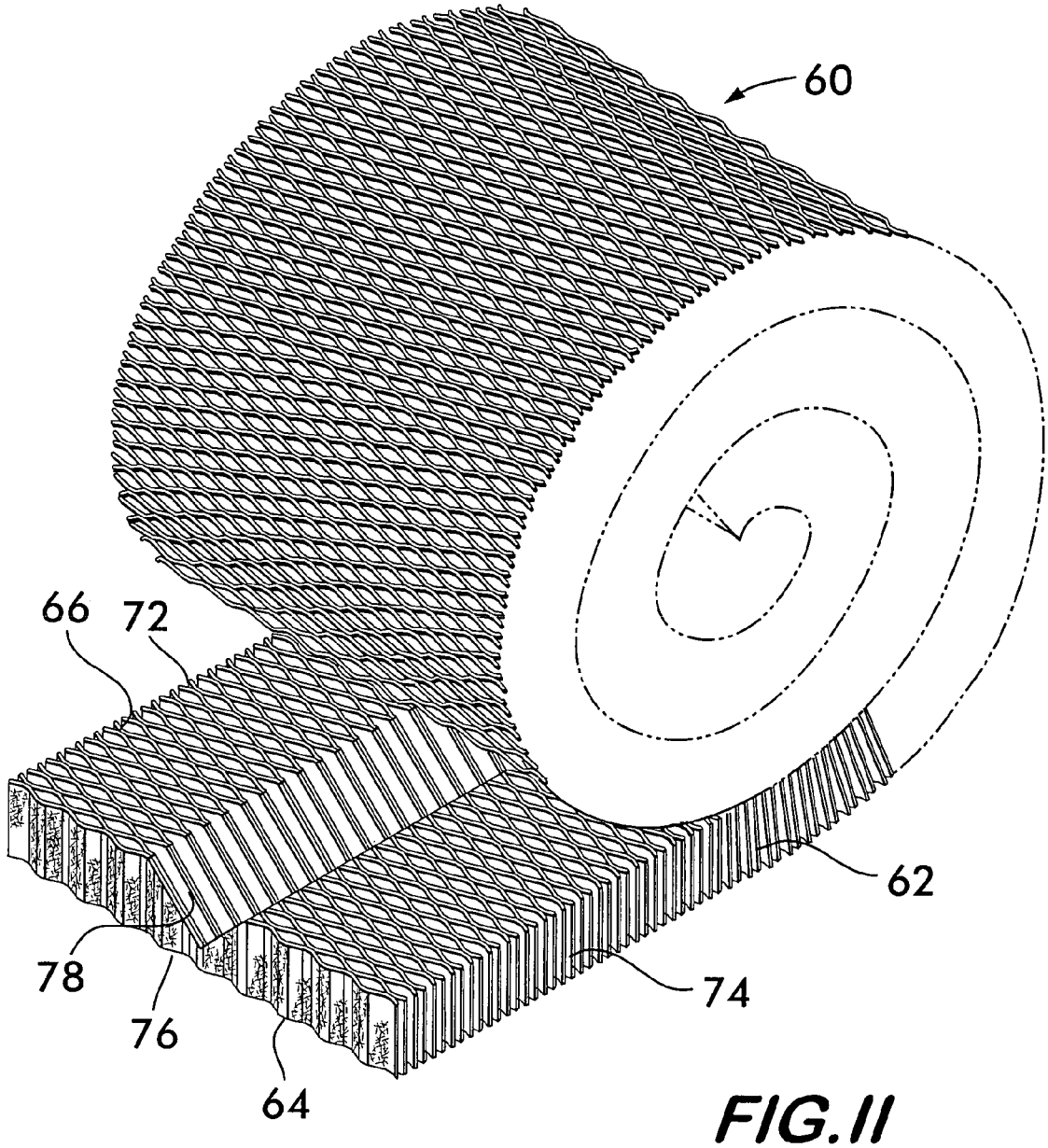
FIG. 11 is a perspective view of the vent of FIG. 10 in a spiral roll.

Additional weather infiltration protection can be provided to vent 44 by providing the outermost edge wall 56 of each honeycomb section 52 with the ability to flex inwardly under the force of wind. To this end, each section 52 is bonded to the backer sheet 46 with the exception of the outermost edge wall 56, which is free to pivot relative to the backer sheet 46. Thus, as best illustrated in FIG. 9, the edge walls 56 can pivot into engagement with a wall of an adjacent section 52 when wind blows in a direction into the side edge of the vent as illustrated by arrows 58. The inward deflection of the edge wall 56 closes the ventilation path 54 and prevents wind driven rain, snow or the like from entering the vent 44 and reaching the slot 22.

A third embodiment according to the present invention is illustrated in FIGS. 10-13. A vent 60 is constructed entirely, or substantially entirely, of a continuous elongate strip of honeycomb ventilation material 62, without a backer sheet or the like. The upper surface 64 of the honeycomb material 62 directly supports cap shingles 20 or the like thereon, and the underside 66 confronts the underlying roof surface. The honeycomb material 62 is sufficiently strong to support cap shingles 20 that are nailed to the roof 10 above the surface of the roof ridge 16, and the walls 68 and cavities 70 of the honeycomb material 62 are air permeable permitting air to vent laterally therethrough to the side edges, 72 and 74, of the vent 60. See FIG. 13. The longitudinally-extending central section 76 of the vent 60 includes an inverted-V cut 78 or the like to permit the honeycomb material 62 to flex about the roof ridge 16 and conform to the shape of the roof ridge 16.

By way of example, and not by way of limitation, any of the above described ridge vents can be made in indefinite, continuous lengths having a width "W" of about 7 to about 12 inches and a height "H" of about 0.5 to about 1 inch. Larger or smaller dimensions can also be utilized.

Each of the above referenced ridge vents are installed by placing an elongate length of the vent over the open slot 22 formed along the roof ridge 16. Preferably, the vent is provided in a spiral roll, is unrolled lengthwise on the roof ridge, and is aligned therewith. The vent is secured to the underlying roof surface with nails, staples, adhesives, or the like and cap shingles 20 or the like are secured thereon.

The above-described roof ridge vents according to the present invention provide a uniquely constructed roll-form vent that is easy to install, is inexpensive to manufacture, provides a desired amount of air flow therethrough, and prevents weather infiltration.

While preferred roof ridge vents and roof ridge vent installations have been described in detail, various modifications, alterations, and changes may be made without departing from the spirit and scope of the vent and installations according to the present invention as defined in the appended claims.

The invention claimed is:

1. A roof ridge vent, comprising:

an elongate, continuous strip of honeycomb material having walls defining a plurality of separate open cellular cavities, said strip having an upper face for supporting cap shingles thereabove, a lower face for engaging a roof surface, and a pair of longitudinally-extending side edges through which paths of ventilation are provided;

said walls and cavities of said material extending in a direction from said lower face to said upper face and said paths of ventilation extending transversely through said walls.

2. A roof ridge vent according to claim 1, wherein said vent is rollable lengthwise into a spiral roll for storage and transport.

3. A roof ridge vent according to claim 1, wherein said walls of said material are perforated.

4. A roof ridge vent according to claim 1, wherein said walls of said material are made of an air permeable material that provides multiple flowpaths therethrough.

5. A roof ridge vent according to claim 4, wherein said air permeable material is a non-wicking hydrophobic material having a multiplicity of closely spaced openings for the flow of venting air therethrough.

6. A roof ridge vent according to claim 4, wherein said air permeable material is a non-woven fabric.

7. A roof ridge vent according to claim 1, wherein said walls of said material have a composite strength in compression sufficient to support overlying cap shingles.

8. A roof ridge vent according to claim 1, wherein said open cavities of said material are of a shape selected from a group consisting of: multi-sided, hexagon, square, rectangular, triangular, diamond, circular, and oval.

9. A roof ridge vent according to claim 1, further comprising a continuous, elongate strip of sheet material having an upper face for supporting cap shingles and an underside secured to said upper face of said material that has walls defining a plurality of separate open cellular cavities.

10. A roof ridge vent according to claim 9, wherein said material that has walls defining a plurality of separate open cellular cavities is provided as a separate pair of continuous, elongate strips that are secured to the underside of said sheet material such that said strips are located on opposite sides of a longitudinally-extending centerline of said sheet material.

11. A roof ridge vent according to claim 9, wherein said sheet material is made of a thermoplastic material and said material that has walls defining a plurality of separate open cellular cavities is thermally or adhesively bonded to the underside of said sheet material.

12. A roof ridge vent according to claim 9, wherein said sheet material is made of a non-woven fabric.

13. A roof ridge vent, comprising:

a continuous, elongate strip of sheet material having an underside; and a ventilation material having walls defining a plurality of separate open cellular cavities, said ventilation material being secured to said underside of said sheet material such that said walls and cavities extend downwardly from said sheet material in a direction substantially perpendicular to said sheet material;

said ventilation material defining paths of ventilation that extend transversely through said walls.

14. A roof ridge vent according to claim 13, wherein said ventilation material is a honeycomb material.

15. A roof ridge vent according to claim 14, wherein said vent is rollable lengthwise into a spiral roll for storage and transport.

16. A roof ridge vent according to claim 15, wherein said walls of said ventilation material have a composite strength in compression sufficient to support overlying cap shingles.

17. A roof ridge vent according to claim 14, wherein said walls of said ventilation material are perforated.

18. A roof ridge vent according to claim 14, wherein said walls of said ventilation material are made of an air permeable material that provides multiple flowpaths therethrough.

19. A roof ridge vent according to claim 18, wherein said air permeable material is a non-wicking hydrophobic material having a multiplicity of closely spaced openings for the flow of venting air therethrough.

20. A roof ridge vent according to claim 18, wherein said air permeable material is a non-woven fabric.

21. A roof ridge vent according to claim 14, wherein said open cavities of said honeycomb ventilation material are of a shape selected from a group consisting of: multi-sided, hexagon, square, rectangular, triangular, diamond, circular, and oval.

22. A roof ridge vent according to claim 21, wherein said ventilation material comprises a separate pair of continuous, elongate strips that are secured to the underside of said sheet material such that said strips are located on opposite sides of a longitudinally-extending centerline of said sheet material.

23. A roof ridge vent according to claim 21, wherein said sheet material is made of a thermoplastic material or a non-woven fabric, and wherein said ventilation material is thermally or adhesively bonded to the underside of said sheet material.

24. A roof ridge vent installation, comprising:

a roof having a ridge with an elongate open slot;

an elongate, continuous ridge vent secured to said roof overlying said ridge and open slot, said vent having a pair of longitudinally-extending side edges; and cap shingles secured to said roof overlying said ridge vent;

said vent being constructed of a honeycomb ventilation material having walls defining a plurality of separate open cellular cavities, said walls of said ventilation material being oriented in an upstanding position relative to said underlying roof and providing a path of ventilation transversely therethrough from said open slot to said side edges of said vent.

25. A roof ridge vent installation according to claim 24, wherein said walls of said ventilation material are perforated.

26. A roof ridge vent installation according to claim 24, wherein said walls of said ventilation material are made of an air permeable material that provides multiple flowpaths therethrough.

27. A roof ridge vent installation according to claim 26, wherein said air permeable material is a non-wicking hydrophobic material or a non-woven fabric having a multiplicity of closely spaced openings for the flow of venting air therethrough.

28. A roof ridge vent installation according to claim 24, wherein said walls of said ventilation material have a composite strength in compression sufficient to support said overlying cap shingles.

29. A roof ridge vent installation according to claim 24, wherein said open cavities of said ventilation material are of a shape selected from a group consisting of:

multi-sided, hexagonal, square, rectangular, triangular, diamond, circular, and oval.

30. A roof ridge vent installation according to claim 24, wherein said vent includes a continuous, elongate strip of sheet material having an upper face supporting said cap shingles and an underside secured to said ventilation material, and wherein said ventilation material spaces said sheet material from said underlying roof and open slot.

31. A roof ridge vent installation according to claim 30, wherein said ventilation material comprises a pair of continuous, elongate strips that are secured to the underside of said sheet material such that said strips extend on opposite sides of said open slot.

32. A roof ridge vent installation according to claim 30, wherein said sheet material is made of a thermoplastic material or a non-woven fabric, and wherein said ventilation material is thermally or adhesively bonded to the underside of said sheet material.

* * * * *